US005988409A

United States Patent [19]

Gusdorf et al.

[11] Patent Number: 5,988,409

[45] **Date of Patent: *Nov. 23, 1999**

[54] VERTICAL WALL RACK AND VARIABLE SHELF ARRANGEMENT

[75] Inventors: John Gusdorf; Fred D. Oberhaus; Mohammad Massoudnia, all of St. Louis, Mo.

[73] Assignee: Industrial Wire Products, Inc., Sullivan, Mo.

[ * ] Notice: Under 35 U.S.C. 154(b), the term of this patent shall be extended for 351 days.

[21] Appl. No.: 08/505,465

[22] Filed: Jul. 21, 1995

[51] Int. Cl.[6] ..... A47F 5/08

[52] U.S. Cl. ..... 211/90; 248/175

[58] Field of Search ..... 211/90, 88, 103, 211/106, 34, 35, 36, 37, 181, 188; 248/175, 222.41

[56] References Cited

U.S. PATENT DOCUMENTS

| | | | |
|---|---|---|---|
| D. 165,118 | 11/1951 | Strinning et al. . | |
| D. 295,472 | 5/1988 | Remmers | D6/465 |
| D. 305,272 | 12/1989 | Remmers | D34/42 |
| D. 311,860 | 11/1990 | Remmers | D8/381 |
| D. 312,389 | 11/1990 | Remmers | D8/381 |
| 2,428,073 | 9/1947 | Handel | 211/87 |
| 2,733,037 | 1/1956 | Dunham | 248/222.41 X |
| 2,827,254 | 3/1958 | Faber | 248/243 |
| 3,184,068 | 5/1965 | Wende | 211/103 X |
| 3,198,343 | 8/1965 | Pollock | 211/87 |
| 3,221,893 | 12/1965 | Glakerson et al. | 211/103 X |
| 3,294,351 | 12/1966 | Rollins, Jr. | 248/243 |
| 3,486,632 | 12/1969 | Balch | 211/57 |
| 3,604,669 | 9/1971 | Asher | 248/243 |
| 3,913,745 | 10/1975 | Weiss | 211/34 |
| 3,918,670 | 11/1975 | Doherty | 211/35 X |
| 3,993,002 | 11/1976 | Stroh | 211/90 X |
| 4,098,481 | 7/1978 | Johnson et al. | 211/90 X |
| 4,415,091 | 11/1983 | Wolff | 211/103 X |
| 4,470,512 | 9/1984 | Buffington et al. | 211/90 |
| 4,548,327 | 10/1985 | Kilkelly | 211/187 |
| 4,550,893 | 11/1985 | Wiersema et al. | 248/222.4 |
| 4,693,380 | 9/1987 | Muth | 211/35 |
| 4,732,284 | 3/1988 | Remmers | 211/188 |
| 4,781,349 | 11/1988 | Remmers | 248/249 |
| 4,783,035 | 11/1988 | Remmers | 248/250 |
| 4,795,041 | 1/1989 | Remmers | 211/133 |
| 4,840,279 | 6/1989 | Cobb et al. | 211/88 |
| 4,858,773 | 8/1989 | Zimmerman | 248/222.41 X |
| 5,039,046 | 8/1991 | Brewster | 248/206.3 |
| 5,072,839 | 12/1991 | Arnone | 211/187 |
| 5,076,442 | 12/1991 | Hakeem | 211/162 X |
| 5,314,080 | 5/1994 | Wentworth | 211/186 X |
| 5,318,187 | 6/1994 | Rosenthal | 211/88 |
| 5,443,167 | 8/1995 | Menaged et al. | 211/103 X |
| 5,485,932 | 1/1996 | Romm et al. | 211/103 X |
| 5,526,941 | 6/1996 | Ford | 211/106 X |

*Primary Examiner*—Ramon O. Ramirez
*Attorney, Agent, or Firm*—Paul M. Denk

[57] ABSTRACT

A storage system having a pair of parallel, spaced side braces and a plurality of interchangeable wire racks, shelves and baskets secured and suspended between the side braces. The side braces are mounted directly to a wall or other flat surface. The side braces are provided in interlocking sections and can be joined together to form a side brace as long as desired. Each side brace has a plurality of evenly spaced keyhole-shaped openings formed in an inner surface. The openings in one side brace are parallel to the openings in the other side brace. Each shelf, rack or basket has side extensions designed to engage the openings. Each side extension terminates in a retention means, for example a knob that engages and is secured in the opening. The rack, shelf or basket can be moved between openings to raise or lower the height of the unit.

8 Claims, 2 Drawing Sheets

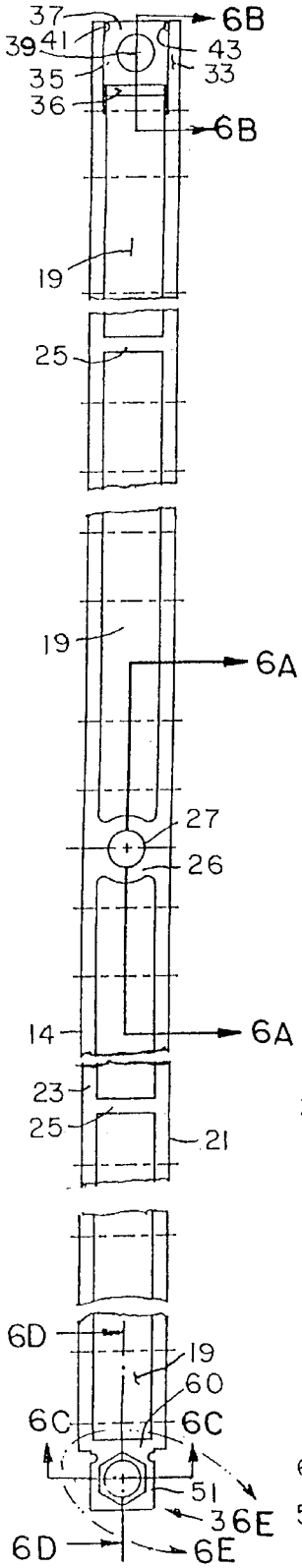
FIG. 6
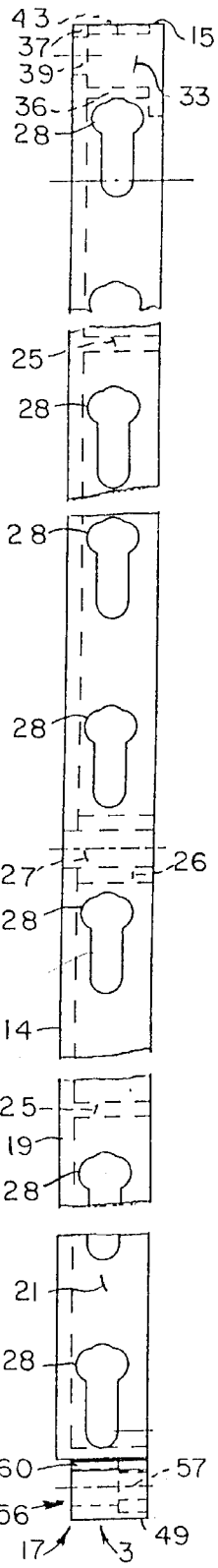
FIG. 7
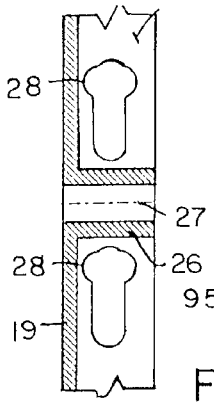
FIG. 6A
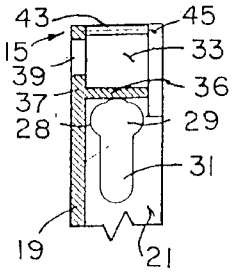
FIG. 6B
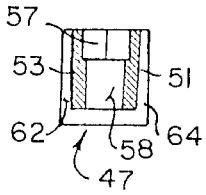
FIG. 6C
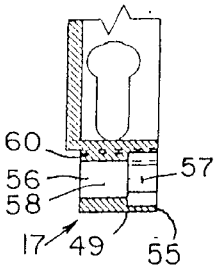
FIG. 6D
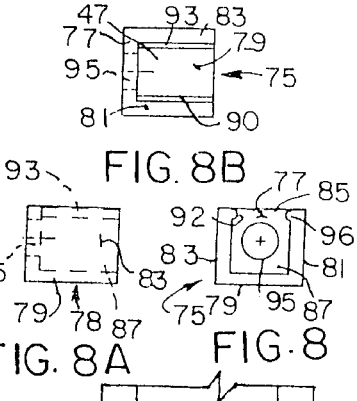
FIG. 8B
FIG. 8A
FIG. 8
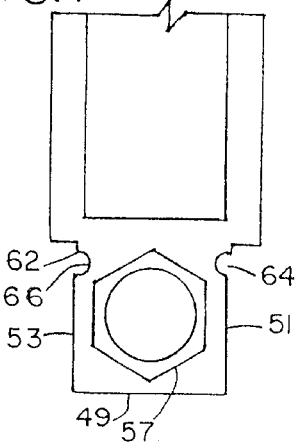
FIG. 6E
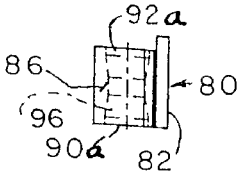
FIG. 9B
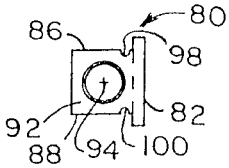
FIG. 9
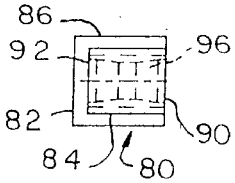
FIG. 9A

VERTICAL WALL RACK AND VARIABLE SHELF ARRANGEMENT

BACKGROUND OF THE INVENTION

This invention relates to storage systems, more particularly to an adjustable wire shelving storage system having interchangeable components.

Shelving units are known to the art. In general, shelves must be built into a building upon construction or renovation to afford storage space to the inhabitant. In most cases, storage areas are planned into the building in the form of closets, cabinets or pantries. These planned storage areas generally contain some shelving to facilitate the orderly storage of belongings. Once the construction or renovation of the building is completed the storage space is limited to those preplanned storage areas. It is time consuming and expensive to add additional storage. It is not uncommon to discover, upon completion of construction or renovation, that the storage areas are limited. That is, the inhabitants of the building often discover that they need more storage space or that the storage space provided is unhandy. Furthermore, as the number of inhabitants increases, more storage space is needed.

Often a homeowner realizes that the closets or cabinets are too small to accommodate all of the items to be stored. For example, the closets may be too small to accommodate shoes as well as clothing. Or, the kitchen cabinets may not have the capacity to hold all of the food stuffs, spices or cooking utensils required by a growing family. Moreover, even in situations where there is sufficient storage space, it may be desirable to better organize the items stored. For example, toys, sporting equipment or cleaning supplies may be scattered about a room or house. Tools or automobile are randomly stashed in a garage or workarea. It would be desirable to have a storage system having interchangeable components that is easily installed to increase the amount of storage area to facilitate the organization and storage of personal belongings.

OBJECTS OF THE INVENTION

It is, therefore, among the principal objects of the present invention to provide a storage system that can be assembled and mounted in an existing structure to facilitate the organization and storage of personal belongings.

A further object of this invention is to provide substantial stability to the mounting and support of items against a vertical surface, whether it be a wall, door, or the like through the use of an integrated vertical wall rack and various shelf arrangements.

A further object of this invention is to provide a vertical wall rack, when disassembled, as for shipment and display, can be reduced to substantially small dimensions, with no section being over four feet in length, while prior art devices come in much greater sizes, add to the inconvenience of their usage.

Still another object of this invention is to provide a vertical wall rack which is completely adjustable, providing for various types of shelving, at various levels, depending on the desire of the user.

It is another object of the present invention to provide such a storage system that has interchangeable shelving and rack components so as to maximize the utility of the system.

Still another object of the present invention is to provide such a storage system that can be installed in existing structure and requires no structural modification.

Yet another object of the present invention is to provide such a storage system that can maximize preexisting storage space.

Another object of the invention is to provide such a storage system that is economical to manufacture, easy to install, easy to use, and well suited for its intended purposes.

In accordance with the invention, briefly stated, a storage system having a pair of spaced side braces and a plurality of interchangeable wire shelves, racks and baskets suspended between the side braces. The side braces are mounted directly to a wall or other surface, or even to the inside surface of a door. The vertical side braces are provided in interlocking sections and can be joined together to make a side brace as long as desired. Each side brace section has a plurality of key hole shaped openings on an inner surface. The openings in one side brace are parallel to the openings in the other side brace. Each shelf and basket has side extensions on each side designed to engage the keyhole shaped openings. Each side extension terminates in an engagement means, for example a knob, or coined portion, that engages the opening. The engagement means are secured in the openings to suspend the rack or basket between the side braces. The rack or basket can be moved between parallel openings so as to raise or lower the height of the rack or basket.

BRIEF DESCRIPTION OF THE DRAWINGS

FIG. 6 is a rear elevation of a section of a side brace of the adjustable wire shelving system of the present invention;

FIG. 6A is a section view of the side brace taken along line 6A—6A of FIG. 6;

FIG. 6B is a section view of the side brace taken along line 6B—6B of FIG. 6;

FIG. 6C is a section view of the side brace taken along line 6C—6C of FIG. 6;

FIG. 6D is a section view of the side brace element taken along line 6D—6D of FIG. 6;

FIG. 6E an enlarged partial section view of the side brace element taken at circle 6E—6E;

FIG. 7 is a side elevation of the section of side brace shown in FIG. 6;

FIG. 8 is a bottom plan of a side brace cap;

FIG. 8A is an end plan thereof;

FIG. 8B is a side elevation thereof;

FIG. 9 is a end plan of a side brace plug;

FIG. 9A is a top plan thereof; and

FIG. 9B is a side elevation thereof.

Figures 1, 2, 2A, 3, 3A, 4, 4A, 5, 5A:
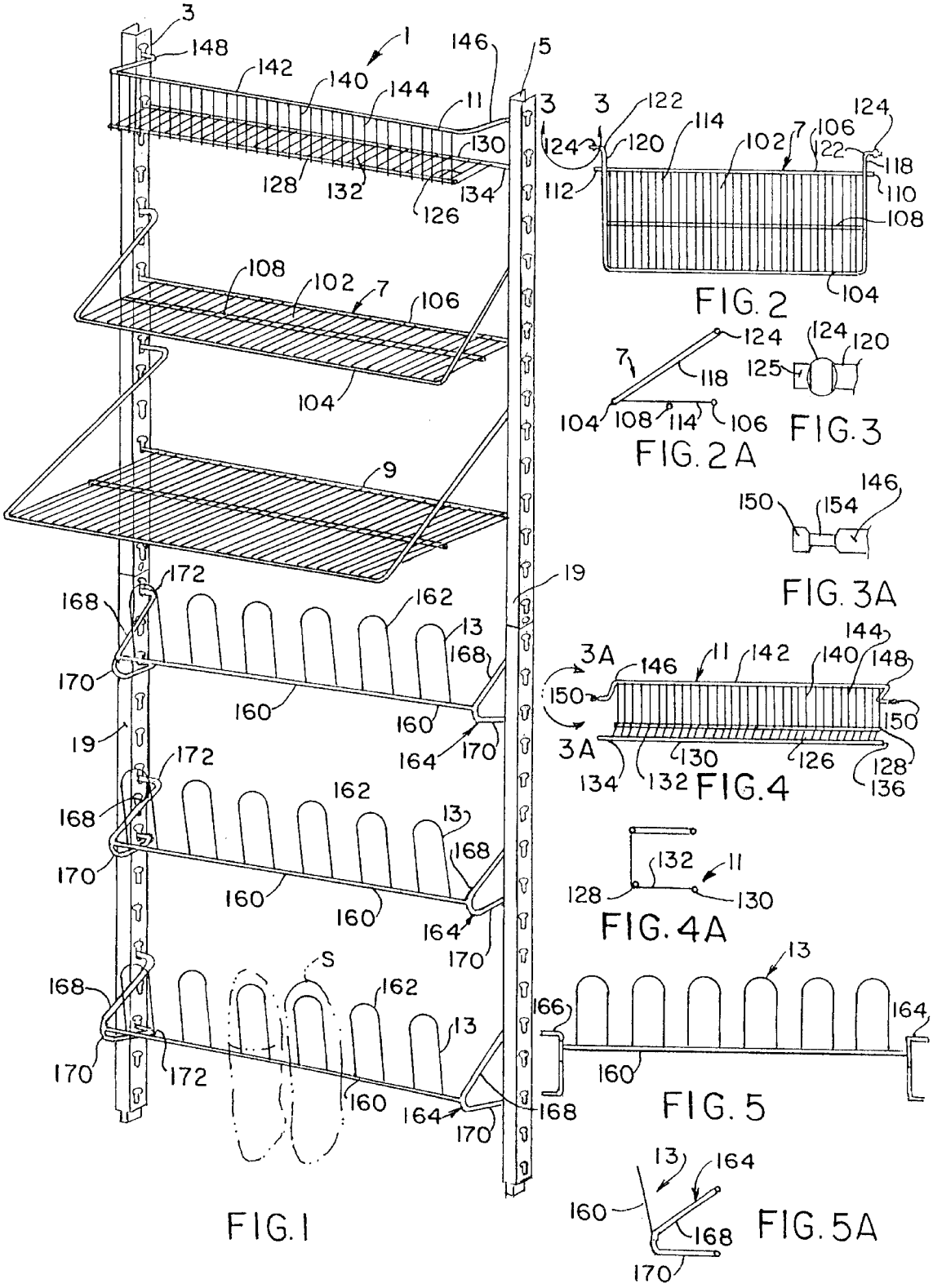
FIG. 1 is an isometric view of the adjustable wire shelving system of the present invention.
FIG. 2 is a top plan of a shelf element of the adjustable wire shelving system of the present invention.
FIG. 2A is a side view of the adjustable wire shelving system disclosed in FIG. 2.
FIG. 3 is a side elevation of one embodiment of a slot engagement segment, formed as coined means, of a side extension from a shelf element of the adjustable wire shelving segment the present invention.
FIG. 3A is another embodiment of a slot engagement segment of a side extension from a shelf element of the adjustable wire shelving segment of the present invention.
FIG. 4 is a top plan of a rack element of the adjustable wire shelving system of the present invention.
FIG. 4A is end plan thereof.
FIG. 5 is a front elevation of a shoe rack element of the adjustable wire shelving system of the preset invention.
FIG. 5A is an end plan thereof.

Corresponding reference figures indicate corresponding structure throughout the various drawings.

DESCRIPTION OF THE PREFERRED EMBODIMENT

An adjustable wire shelving system of the present invention is indicated generally by reference numeral 1 in the drawings. Shelving system I has a pair of opposed side braces 3 and 5 as well as a plurality of interchangeable shelves 7 and 9 racks 11 and specialty racks 13. The individual elements of system 1 will now be described in greater detail.

As can be seen in FIG. 1, which provides a composite of various styles of shelving and rack elements mounted to the vertical wall rack of this invention, the lower section of FIG. 1 shows the vertical wall rack of a pair of vertically aligned side braces with a series of shoe racks and discloses how a series of shoe racks can be applied at various height dimensions to furnish a multiple storage of pairs of shoes at any given time. In addition, the upper segment of this particular vertical rack discloses how a series of shelvings, whether they be of the basket type for holding bottles or the like, or flat shelves for holding towels, etc., can be interchangeably replaced upon the vertical wall rack, as desired.

In addition, these racks may be of differing sizes. For example, where the rack may be used for supporting shoes, the shoe racks may be of a narrower width and, therefore, the use of one or more braces, incorporating a series of vertically located shoe racks, may be used alone in this installation. Likewise, a series of shelves, whether of the flat style or basket type, may be used along the height of this particular device. But, where the shelving is of the same approximate width, combinations of such shelves and racks may be employed, in a further embodiment.

It is to be noted that what is significantly convenient through the usage of this invention is the application of coined end members, into the keyhole-like openings 28, and into which various of the racks and shelving may conveniently, and with high stability, fit for holding the assembled vertical wall rack together, into position, for application to a vertical surface, such as a wall.

Side braces 3 is shown in greater detail in FIGS. 6–7. Side brace 5 is an exact mirror image of side brace 3. It will be appreciated that the side braces come in interlocking sections of variable length so that any number of sections can be interconnected to make a side brace of desired length, as will be described in greater detail hereinafter. Each section is made from an appropriate material such as a lightweight painted or vinyl coated metal or plastic of sufficient strength and durability. Each section of brace 3 has a elongated body 14 having top or first end 15 and a bottom or second end 17. Body 14 has a substantially U-shaped cross section formed a solid front wall 19 with a first perforated side wall 21 and a second perforated side wall 23 integrally attached thereto at right angles to the front wall. When mounted on a flat surface, the open backside of the brace is positioned adjacent the surface. There are spaced cross members 25 positioned between the respective side walls to add support to the brace. Also between the walls are a plurality of bosses 26, shown in greater detail in FIG. 6A. Each boss 26 has a bore 27 formed centrally therein, for the insertion of mounting screws or other hardware (not show). The bosses 26 are space evenly along the length of body 14 and positioned to provide optional support to the entire length of body 14 when the brace is mounted.

Side wall 21 is shown in greater detail in FIG. 7. It will be appreciated that side wall 23 is the mirror image of side wall 21. Side wall 21 has a plurality of openings 28 evenly spaced along the length of the wall. Each opening has a keyhole-like configuration, As shown in FIG. 6B, opening 28 has a substantially round upper section 29 and a narrower, elongated lower section 31. Obviously, the round section is for insertion of a rack end, while the narrower portion locks the installed rack into position.

The first or top end 15 of the brace is shown in greater detail in FIGS. 6 and 6B. Top end 15 is defined by short end segments 33 and 35 of walls 21 and 25 respectively, a cross member 36 and a short end segment 37 of front wall 19. There is an opening 39 formed centrally in wall segment 37. Opening 39 is designed to allow the introduction of a screw or other attachment means. There is a first bead 41 that runs along the edge of segment 35 and a second opposed bead 43 running along the lower edge of segment 33. As seen in FIG. 6B, the cross member 36 and the beads 41 and 43 do not extend the width of the respective segments 35 and 33 thereby creating an offset 45 to accommodate the attachment of a lower end 17 of another section, positioned thereabove, of side brace as will now be described.

The lower end 17 of the side brace section is shown in greater detail in FIG. 6D. The lower section has a tip 47. Tip 47 has a generally square cross section defined by a top wall 49, opposed side walls 51 and 53 and a face wall 55. The side walls are shorter than walls 21 and 23 resulting in an offset 56. As best seen in FIG. 6C, there is a mounting hole 57 formed centrally in face wall 55 and is counterbored to a bore 58. Counterbored hole 57 allows the recess seating of a mounting screw or other appropriate hardware. A neck 60 connects tip 47 to the lower end of the body 14. Neck 60 has a first compound groove 62 at the base of side wall 53 and a second compound groove 64. Groove 62 has an outer section 66 and a smaller recessed section 68. Groove 64 has an outer section 70 and a small recessed section 72. The recessed sections of the respective grooves seat beads 41 and 43 when two sections of side brace are joined end to end. The outer sections seat larger beads formed on end caps as will now be described in greater detail.

An end cap, shown in greater detail in FIGS. 8–8B, is indicated, generally, by reference numeral 75. Cap 75 has a rear wall 77, a bottom wall 79, a first side wall 81, a second side wall 83 and an open front 85 which define an open-sided chamber 87. Chamber 87 is configured and dimension to fit over tip 17 from the front. There is a first bead 90 along side wall 81 and a second bead 92 along wall 83. The beads 90 and 92 are dimensioned to engage grooves 62 and 64. There is hole 95 formed in rear wall 77. Hole 95 is designed to align with hole 57 in tip 47 when cap 75 covers tip 47. Rear wall 77 fits in off-set 56 and bottom wall 79 covers top wall 49 of the tip to impart a clean finished look to the side brace when cap 75 is installed.

The upper end 15 of a section of side brace is finished with an end plug, indicated generally by reference numeral 80 in FIGS. 9–9B. Plug 80 has a flat bottom wall 82. A plug segment 84 is integrally attached to wall 82. Plug segment 84 has a substantially cube configuration formed by bottom wall 82, side wall 86 and 88 and end walls 90*a* and 92*a*. An opening 94 is formed in end wall 90*a* and communicates with a bore 96 extending through the plug segment 84. There is a first groove 98 formed in wall 86 and a second groove 100 formed in wall 88. The grooves 98 and 100 are designed to engage beads 41 and 43 formed in end 17.

As stated above, interchangeable shelves 7 and 9, as well as interchangeable racks 13 are suspended between side braces 3 and 5. Shelf 7 is shown in greater detail in FIGS. 2 and 2A. Shelf 7 has a substantially rectangular platform 102. Platform 102 is constructed as a grid having a front edge bar 104, a rear edge bar 106 and a middle support bar 108. Rear edge bar 106 is longer than the front edge bar 104 resulting in a first extension 110 and a second extension 112 which extend laterally beyond platform 102. A plurality of cross bars 1 14 extend from the front edge bar 104 to the rear edge bar 106 and are attached to the middle support bar 108. The individual cross bars 114 are equally spaced along the length of the edge bars. There are spaces 116 between the cross bars. The cross bars 114 are spaced so that spaces 116 are not so large as to allow objects placed on platform 102 to fall between the bars. It will be appreciated that the respective support, edge and cross bars can be formed from heavy gauge steel, into the formation of the various components for this rack, and then these formed components can subsequently be painted or vinyl coated, as a vinyl coated wire, or can be formed from a sufficiently durable or resilient plastic or other resin material. But, in the preferred embodiment, vinyl coated formed wire is preferred.

There is a first angled brace 118 extending upward from one end edge bar 104 and a second angled brace 120 extending upward from the opposite end of front edge bar 104. Each brace has an elbow 122 that terminates in a retention knob 124. Knob 124, which may be a coined area, has an extension tip 125 to facilitate introduction of the knob into an opening, as will be explained below. The knob 124 is shown in greater detail in FIG. 3. The knob 124 is a substantially spherical and is dimension so that it is smaller than round segment 29 of opening 28 yet larger than narrow segment 31 of opening 28. The configuration and dimensions allow the knob 124 to be introduced into opening 28 through segment 29, moved downward by slight pressure or by the weight of objects placed on platform 102 and be secured in opening 28 since knob 124 cannot be drawn through narrow segment of 28, as at 31. It will be appreciated that the angled braces 118 and 120 extend upward from front edge bar 104 at an appropriate angle so that the extensions 110 and 112 on bar 106 fit into an opening 28 when the knobs 124 are secured in an opening 28 to add stability to the shelf when it is suspended between the side braces. It will be noted that shelf 9 is configured the same as shelf 7 having longer cross bars and longer angled braces, making the platform of shelf 9 larger than that of shelf 7. It will be appreciated that the shelves can be raised or lowered by moving the up or down relative to the side braces and engaging higher or lower openings.

Rack 11 is shown in greater detail in FIGS. 4 and 4A. Rack 11 has a substantially rectangular platform 126. Platform 126 has a front edge bar 128, a rear edge bar 130 and a plurality of equally spaced cross bars 132. Rear edge bar has a first extension 134 and a second extension 136 which extend out laterally beyond platform 126. Rack 11 has a vertical front wall 140. Front wall 140 shares front edge bar 128 and has an upper edge bar 142. There is a plurality of vertical bars 144 between bars 128 and 142. Bar 142 has a first extension 146 at one end and a second extension 148 at the opposite end. The extension 146 and 148 are substantially elongated S shaped bars, or, Z bars, each terminating in a retention end 150 or knob 150. End 150 is shown in greater detail in FIG. 3A. End 150 has concentric neck 154 positioned between end 150 and the extension bar. End 150 is dimensioned so that it can be inserted into opening 28 through segment 29 yet be retained behind segment 31, as previously described in relation to knob or coined area, 124. It will be appreciated by those skilled in the art that either a knob 124 or a end 150, can be used in conjunction with the racks and shelves without departing from the scope of the invention. It will also be appreciated that rack 11 functions like a basket when the system is mounted on a flat surface such as a wall or the back of a door or the like. Also, all of the bars 106, 130, etc., will have sufficient resiliency so as to allow their slight bending when initially inserted into the keyhole slots 28, but to straighten out once inserted.

One embodiment of a specialty rack 13 is shown in greater detail in FIGS. 5 and 5A. Rack 13 is designed to hold shoes S, as indicated in FIG. 1. Rack 13 has a horizontal support bar 160. A plurality of hoops 162 extend upward at a desired outward angle from the support bar 160. Each hoop 162 is dimension to hold a shoe S. There is a first support arm assembly 164 at one end of the support bar 162 and a second support arm assembly 166 at the second end. Each support arm assembly, as best seen in FIG. 5 has an upper angled arm 168 and a lower angled arm 170. The arms 168 and 170 are appropriately angled so that the hole engagement end of each arm is properly positioned relative to an opening in a side brace. Each of the last said angled arms has and elbow 172 (FIG. 1.) Each elbow has a retention means at the either, either one constructed in accordance with the knob shown in FIG. 3 or the disc shown in 3A.

It will be appreciated by those skilled in the art that various changes and modifications can be made in the shelving system of the present invention without departing from the scope of the appended claims. For example, various other configurations of the shelves and racks may be employed. Therefore, the description and accompanying drawings should be viewed as illustrative only and should not be construed in a limiting sense.

We claim:

1. An adjustable shelving system comprising:

a first side brace element;

a second side brace element parallel to said first side brace element, each of said side brace elements having a plurality of spaced openings formed in an inner wall thereof;

a plurality of interchangeable shelves positioned between said side brace elements, the inner wall of each of the first and second side braces comprising a side wall for the said brace elements, and said plurality of spaced openings formed in said side walls having a keyhole configuration, said keyhole openings being evenly vertically spaced apart;

a retention means for said shelves comprising a knob, wherein said shelves during installation being bent inwardly to locate their knobs within the keyhole opening, by locating said knobs through the inner side walls of said first and second side brace elements.

2. The shelving system of claim 1 wherein said knobs further comprise a coined means.

3. The shelving system of claim 1 wherein select of said shelves having a plurality of upwardly angled hoops, each said hoop disposed to seat a shoe.

4. The shelving system of claim 1 wherein each said side brace element is comprised of one or more side brace sections, each section being of the same dimensions, and each said section disposed to engage another said section in an interlocking arrangement to heighten each of the first and second side brace elements.

5. The shelving system of claim 1 and wherein each said shelf having lateral extensions, said extensions terminating in said retention means knob and disposed to engage and be secured in said keyhole openings.

6. The shelving system of claim 5 wherein said shelf is comprised of spaced wire bars.

7. The shelving system of claim 6 wherein said shelf has a platform and a front wall vertical to said platform.

8. The shelving system of claim 1 wherein said plurality of interchangeable shelves are formed from wire that is subsequently vinyl coated.

* * * * *